United States Patent [19]

Wagner et al.

[11] Patent Number: 4,606,210

[45] Date of Patent: Aug. 19, 1986

[54] EXTRUSION PRESS FOR MANUFACTURING EXTRUDED SECTIONS FROM METAL BILLETS

[75] Inventors: Alfred Wagner, Steisslingen; Adolf Ames, Hilzingen; Ulf Hodel, Engen, all of Fed. Rep. of Germany

[73] Assignee: Swiss Aluminum Ltd., Chippis, Switzerland

[21] Appl. No.: 677,510

[22] Filed: Dec. 3, 1984

Related U.S. Application Data

[63] Continuation-in-part of Ser. No. 501,431, Jun. 6, 1983, abandoned, which is a continuation of Ser. No. 247,825, Mar. 26, 1981, abandoned.

[30] Foreign Application Priority Data

Apr. 2, 1980 [DE] Fed. Rep. of Germany ..... 3012757

[51] Int. Cl.[4] ..... B21C 23/08; B21C 27/00

[52] U.S. Cl. ..... 72/261; 72/272; 72/273.5

[58] Field of Search ..... 72/261, 264, 272, 273.5, 72/265

[56] References Cited

U.S. PATENT DOCUMENTS

| | | | |
|---|---|---|---|
| 3,178,920 | 4/1965 | Buffet | 72/264 |
| 3,201,966 | 8/1965 | Benteler et al. | 72/264 |
| 3,347,079 | 10/1967 | Rowell | 72/264 |
| 3,391,566 | 7/1968 | Linnerz et al. | 72/265 |
| 3,394,579 | 7/1968 | Hall et al. | 72/261 |
| 3,468,152 | 9/1969 | Croseck et al. | 72/265 |
| 3,528,275 | 9/1970 | Sibler | 72/265 |
| 3,580,038 | 5/1971 | Andreassian | 72/264 |
| 3,724,254 | 4/1973 | Hubert | 72/264 |
| 4,084,422 | 4/1978 | Zilges et al. | 72/273.5 |
| 4,159,560 | 7/1979 | Wagner | 72/272 |

FOREIGN PATENT DOCUMENTS

| | | | |
|---|---|---|---|
| 894737 | 4/1962 | United Kingdom | 72/273.5 |
| 461753 | 2/1975 | U.S.S.R. | 72/273.5 |
| 602261 | 3/1978 | U.S.S.R. | 72/273.5 |

*Primary Examiner*—Lowell A. Larson

*Attorney, Agent, or Firm*—Bachman & LaPointe

[57] ABSTRACT

A process and apparatus for the indirect extrusion of hollow sections over a mandrel having a diameter $d_D$ from a plurality of billets each having a diameter $d_{on}$ wherein the volume throughput of metal is greater than that obtained by the indirect extrusion over a mandrel of said hollow sections from a single hollow billet under the same extrusion force thereby increasing productivity wherein the diameter of the mandrel $d_D$ with respect to the diameter $d_{on}$ of the billet to be extruded over the mandrel is $d_D < 0.4\ d_{on}$.

16 Claims, 8 Drawing Figures

EXTRUSION PRESS FOR MANUFACTURING EXTRUDED SECTIONS FROM METAL BILLETS

CROSS REFERENCE TO RELATED APPLICATIONS

This application is a continuation-in-part of Application Ser. No. 501,431, filed June 6, 1983, now abandoned, which in turn is a continuation of Application Ser. No. 247,825, filed Mar. 26, 1981 now abandoned.

BACKGROUND OF THE INVENTION

The invention relates to an extrusion press for manufacturing sections from metal billets, in particular light metal billets which are introduced into a container and pushed through a shape-giving die by means of an extrusion stem. The invention also relates to a method for manufacturing such sections.

The hot forming of a so-called billet, heated to the extrusion temperature, to produce extruded sections is usually such that the metal billet is enclosed in a container and pushed by the stem of a hydraulic press through a stationary shape-giving die.

With the so-called indirect method of extrusion a billet is loaded into the container, compressed there, and then the die pushed into the stationary container.

The die rests on a long extrusion stem which must be hollow as the resultant extrusion has to pass through it.

In view of the above, it is an object of the invention to develop an extrusion press and method of the kind mentioned at the start, which, in particular with alloys which are hard to extrude, make it possible to manufacture superior products at comparatively less expense and which, above all, are intended to improve the production of extruded, seamless hollow sections.

SUMMARY OF THE INVENTION

This object is achieved by way of the invention in that the inside of the container features a plurality of openings or channels each of which has a die or part of a die and a special extrusion stem in line with it. Particularly suitable in this respect is a container which is movable and has a plurality of openings, and extrusion stems bearing dies, which are aligned with these openings, and over which the container passes simultaneously.

According to the process of the invention a plurality of billets is introduced simultaneously into a common container and forced through the various dies, which, if desired, may also differ from each other in shape.

To produce seamless pipes mainly of small diameter, a plurality of billets is pushed simultaneously from a common container, each billet in the shape-determining section of the die being deformed by a mandrel which is aligned with the die and is mounted on a common, movable extrusion facility.

It is also within the scope of the invention for seamless pipes to be produced by indirect extrusion by employing known types of hollow billets with a special mandrel for each such billet.

Such a device and the corresponding process allow the simultaneous production of a plurality of sections, in particular seamless pipes or hollow sections one above the other or side-by-side, from alloys which are hard to extrude, and this without the risk of causing cracks in the die.

In particularly advantageous versions of the invention the mandrels can be moved relative to their extrusion stems and/or be made exchangeable and/or adjustable parallel to the axis of the extrusion press. This makes the handling of the mandrels easier and, if desired, also makes it possible to guide them in the extrusion direction through the die and therefore obtain a good pipe cross-section even at the end of the extrusion stage.

With certain alloys it has been found advantageous to use the mandrels themselves to make the holes or channels in hollow billets; for this reason the free ends of the mandrels can be pointed in shape.

It is also favorable to provide the mandrels, which can be moved in the direction of their longitudinal axis, with special drive mechanisms, so as to be able to adjust them fully automatically to suit the conditions at the die during the extrusion process; this ability is highly desirable.

The extrusion press according to the invention and the described method are of maximum use especially when very small diameter mandrels are used.

BRIEF DESCRIPTION OF THE DRAWINGS

Further advantages, features and details of the invention are revealed in the following description of preferred exemplified embodiments and with the help of the drawings wherein.

DETAILED DESCRIPTION

Figure 1:
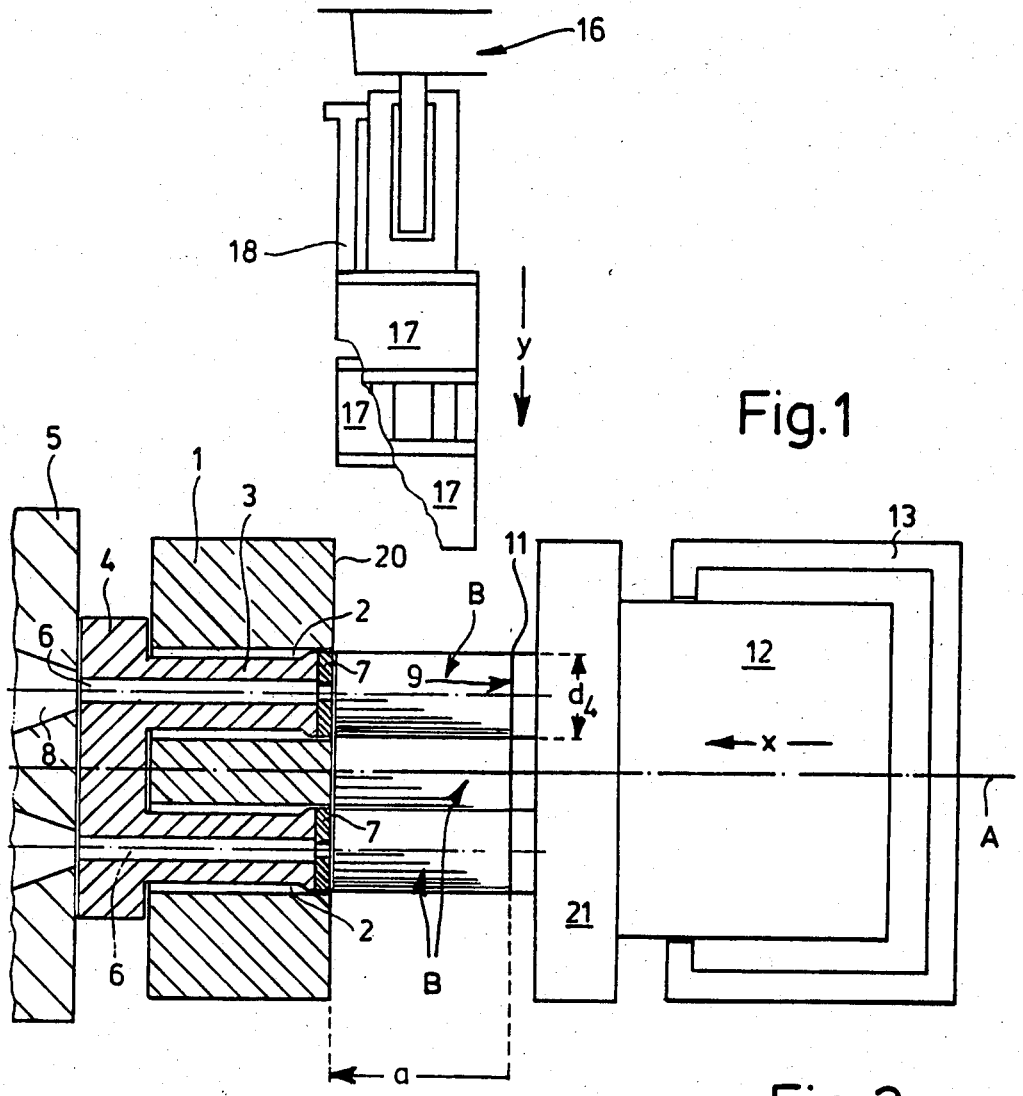
FIG. 1: The partly sectioned plan view of an extrusion press with billet loading chute at the side.

An extrusion press R for indirect extrusion features a container 1 with a plurality of holes or channels 2 which run parallel to the cental axis A of the press R and are for charging simultaneously with a plurality of aluminum billets B. In the example chosen there are four channels 2 of diameter $d_4$ in the container; in the cross-sectional view in FIG. 1 one can recognize two billets B which are sectioned and below these another billet B.

The container 1 can be passed over stationary tools or extrusion stems 3 which are in line with the channels 2 and which have their supporting ends 4 abutting directly onto a crosshead 5.

Figure 2:
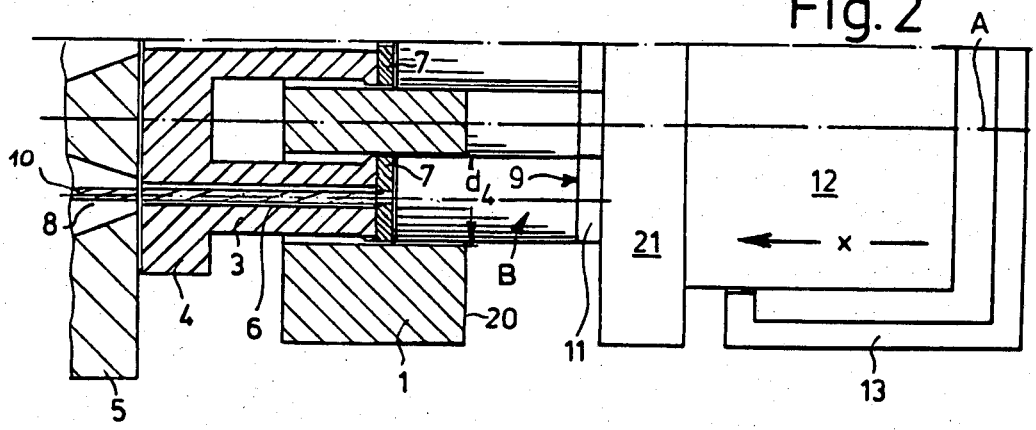
FIG. 2: A part of FIG. 1 showing the extusion press in another operating position.

Inside each stem 3 is a coaxial channel 6 which extends from a shape-giving die 7 to an outlet 8 on the crosshead 5. An extruded section 10 is passing through channel 6 in FIG. 2. Opposite and at a distance a from the dies 7, in the resting position shown in FIG. 1, are the front faces 9 of the sealing discs 11 of the main ram or compression cylinder 12; this is resting in a frame 13 from which it can be driven in the extrusion direction x.

A billet loader 16 is provided at the side of the press R. Concave working surfaces 17 of a loading slide 18, which can move transverse to the main axis A, take aluminum billets B, cylindrical in the example chosen, and, after the loading slide 18 moves in the direction y, set these billets in front of the die 7 and therefore also in front of the channels 2 in the container, thus loading the press R. When the aluminum billets B have been centered by the loading slide 18 in front of the channels 2 in the container, the compression cylinder 12 moves in the direction x towards the billets and presses them against the dies 7; the billets are held, freely clamped between the dies 7 and the front faces 9 of the sealing discs 11, so that the loading slide 18 can withdraw and the container 1 can slide, in the direction opposite to arrow x, over the billets B until its front face 20 rests against a compression plate 21 of cylinder 12.

Press R is now ready, loaded for the extrusion stroke during which the compression cylinder 12 pushes billets B in container 1 simultaneously in direction x through the dies 7, while the container 1 moves towards the crosshead 5 at the same velocity as the billets B being upset in the container 1.

This results in the billets being deformed by the dies 7; the sections thus produced are removed via the channels 6 in the stems 3 and the outlets 8.

Figure 3:
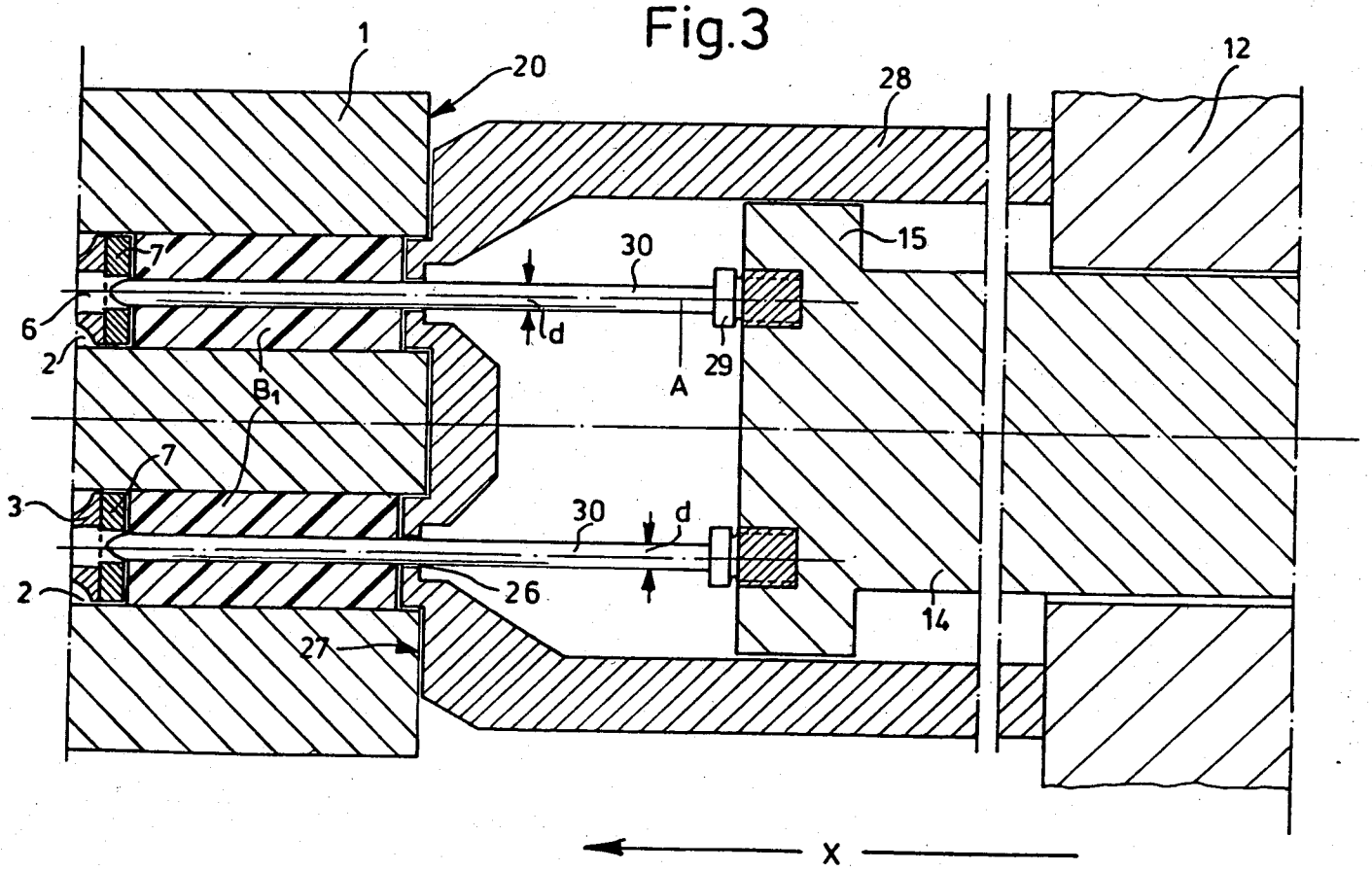
FIG. 3: Part of a longitudinal section through another extrusion press.
Figure 4:
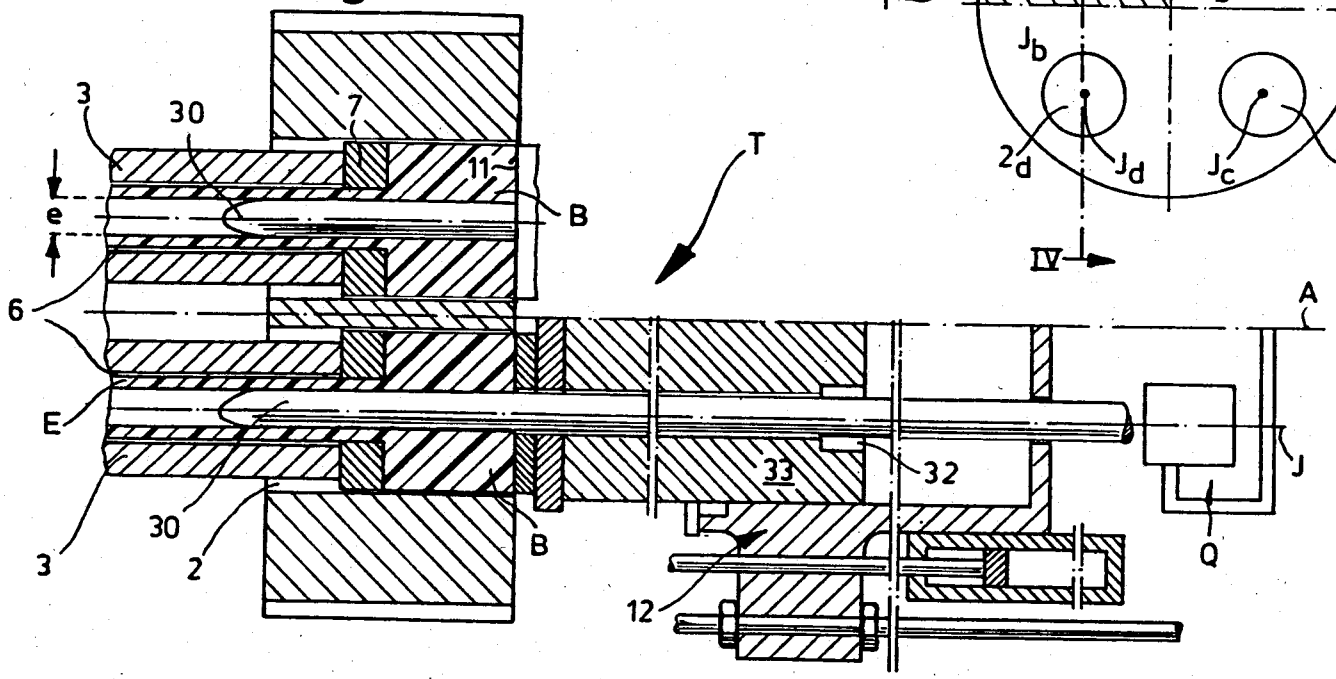
FIG. 4: Part of a section through another exemplified embodiment of the extrusion press approximately along line IV—IV in FIG. 5.

The extrusion press S in FIG. 3, and T in FIG. 4, are used to manufacture tubes E (see FIG. 4) or the like hollow sections of small diameter e.

In the case of the exemplified embodiment in FIG. 3 two mandrels 30 of diameter d in hollow billets $B_1$ are mounted at their threaded ends 29 in a piercer 14 which can be moved with respect to the main compression cylinder 12 and a hollow compression unit 28 resting against the front 20 of the container 1. In this arrangement a collar 15 on the piercer 14 is in contact with the inside face of the container support 28 and as such provides proper alignment. At the front end 27 of the compression unit 28 alignment means 26 are provided for the mandrels 30.

In the example chosen four mandrels 30 project out of the sealing disc 11 of the press T (FIG. 4). Here, the billets B in container 1 are forced by the sealing discs 11 through the shape-giving dies 7, with the mandrels 30 determining the inner diameter e of pipes E which are produced simultaneously.

The mandrels 30 rest, and can be slid in the direction of their central axis J, in bearings 32 in the piston 33 of the compression cylinder 12 and can be pushed by a special facility Q in, or counter to, the direction of extrusion x.

Figure 5:
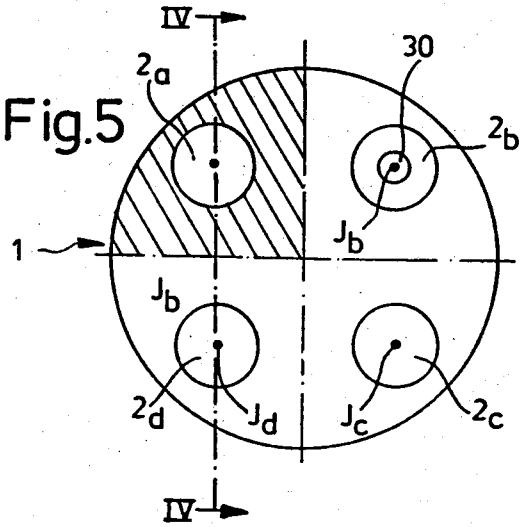
FIG. 5: A smaller scale front elevation of a part of FIG. 4.

In the smaller scale front view of the container 1 shown in FIG. 5 the channels in the container 1 are indicated by numerals *2a* to *2d;* the corresponding axes are indicated by $J_a$ to $J_d$.

Figure 6:
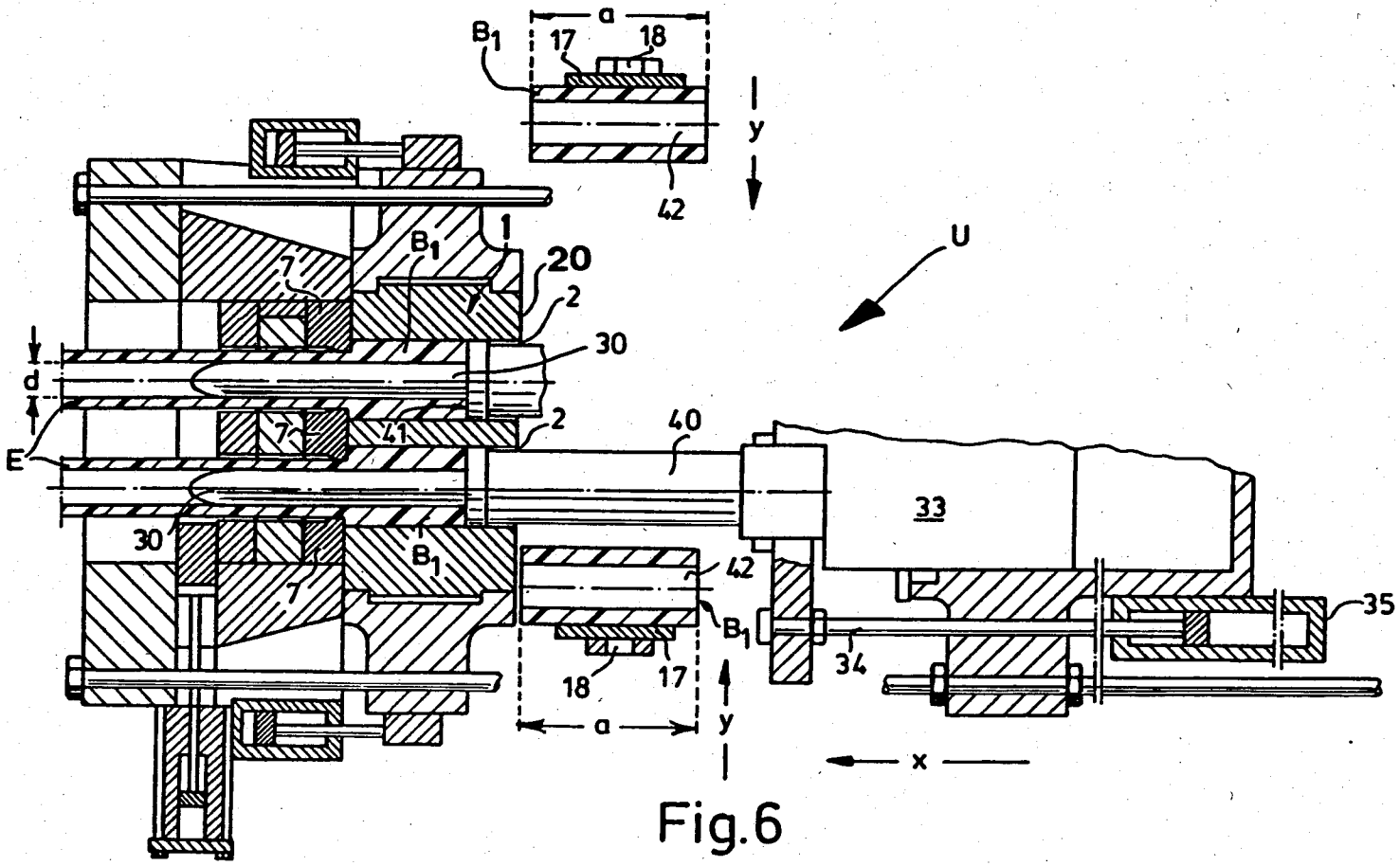
FIG. 6: A view, corresponding approximately to that in FIG. 4, of a direct extrusion press.

The extrusion press U according to FIG. 6 is fitted for the production of tubes E with a plurality of extrusion stems 40 on compression cylinder 12 which project into the channels 2 of the container 1; the maximum distance a between the cylinder side 20 of the container 1 and the front face 41 of the extrusion stem 40 in the resting position, not shown here, is arranged such that the hollow billets $B_1$ supplied by billet loading slide 18 are in line with the container channels 2, and are pushed into the container 1 in the direction of extrusion x by the extrusion stems 40.

The mandrels 30 lying parallel to the stem axes penetrate the interiors 42 of the hollow billets $B_1$. The mandrels 30 and extrusion stems 40 are pushed forward by the piston 33 of the compression cylinder 12. The piston 33 is joined to work cylinders 35 by piston rods 34.

The force required to extrude a billet is the sum of a deformation component and a friction component. The friction between the billet and the container, which represents about 30 to 35% of the total extrusion force applied, is absent in indirect extrusion. As a result, an increase in billet surface area does not lead to a reduction in the force available for deformation of the billet in indirect extrusion to the same extent as in direct extrusion. Therefore, the larger surface area resulting from employing a plurality of billets is not a significant disadvantage in indirect extrusion. On the contrary, it has been found that for certain sized extrusion products productivity can be increased by extruding a plurality of billets.

The foregoing is evidenced by the following example. The force required to indirectly extrude a single billet is defined as follows:

$$\text{deformation component} + \text{friction component} \quad (1)$$

$$F_1 = (A_{o1} - A_D) \cdot l_n \left( \frac{A_{o1} - A_D}{A_1} \right) \cdot k_w + \pi \cdot d_D \cdot l_{o1} \cdot \mu_D \cdot k_w$$

Where:

$A_{o1}$ = Cross sectional area of the one, unpierced billet, that is, $\pi \cdot (d_{o1}^2/4)$ $A_D$ = Cross sectional area of the mandrel = cross sectional area of the hole in the billet to accommodate the mandrel, that is, $(\pi \cdot d_D^2/4)$ $A_1$ = Cross sectional area of the tube $d_{o1}$ = Diameter of the single billet $d_D$ = Diameter of main mandrel $l_{o1}$ = Length of the single billet $\mu_D$ = Coefficient of friction between billet and main mandrel $k_w$ = Resistance to deformation exhibited by material to be extruded.

The force or load required to extrude a plurality of tubes of cross section $A_1$ simultaneously by indirect extrusion of n billets of cross section $A_{on}$ is as follows:

$$F_n = \quad (2)$$

$$n \cdot \left[ (A_{on} - A_D) \cdot l_n \frac{A_{on} - A_D}{A_1} \cdot k_w + \pi \cdot d_D \cdot l_{on} \cdot \mu_D \cdot k_w \right]$$

Where:

$A_{on}$ = Cross sectional area of one of the n billets, that is, $(\pi/4) d_{on}^2$ $d_{on}$ = Diameter of one of the n billets $l_{on}$ = Length of one of the n billets n = Number of billets $A_D$, $d_D$, $\mu_D$, $k_w$ = Same as above when utilizing the full force or load of the extrusion press for extruding $$F_1 = F_n,$$

that is Equation (1) = Equation (2) which allows n to be calculated as follows:

$$n = \frac{(A_{o1} - A_D) \cdot l_n\left(\frac{A_{o1} - A_D}{A_1}\right) + \pi \cdot d_D \cdot l_{on} \cdot \mu_D}{(A_{on} - A_D) \cdot l_n\left(\frac{A_{on} - A_D}{A_1}\right) + \pi \cdot d_D \cdot l_{o1} \cdot \mu_D} \quad (3)$$

The number n therefore depends on the diameter and length of the n billets and on the mandrel diameter:

$$n = f(d_{on}; l_{on}; d_D)$$

This dependency is illustrated in FIG. 3, whereby in order to have general validity the following normalizing was carried out:

$$d_{on} \longrightarrow \frac{d_{on}}{d_{o1}}$$

$$l_{on} \longrightarrow \frac{l_{on}}{l_{o1}}$$

$$d_D \longrightarrow \frac{d_D}{d_{o1}}$$

Such that $$\frac{d_{on}}{d_{o1}} = f\left(n; \frac{l_{on}}{l_{o1}}; \frac{d_D}{d_{o1}}\right)$$

Figure 7:
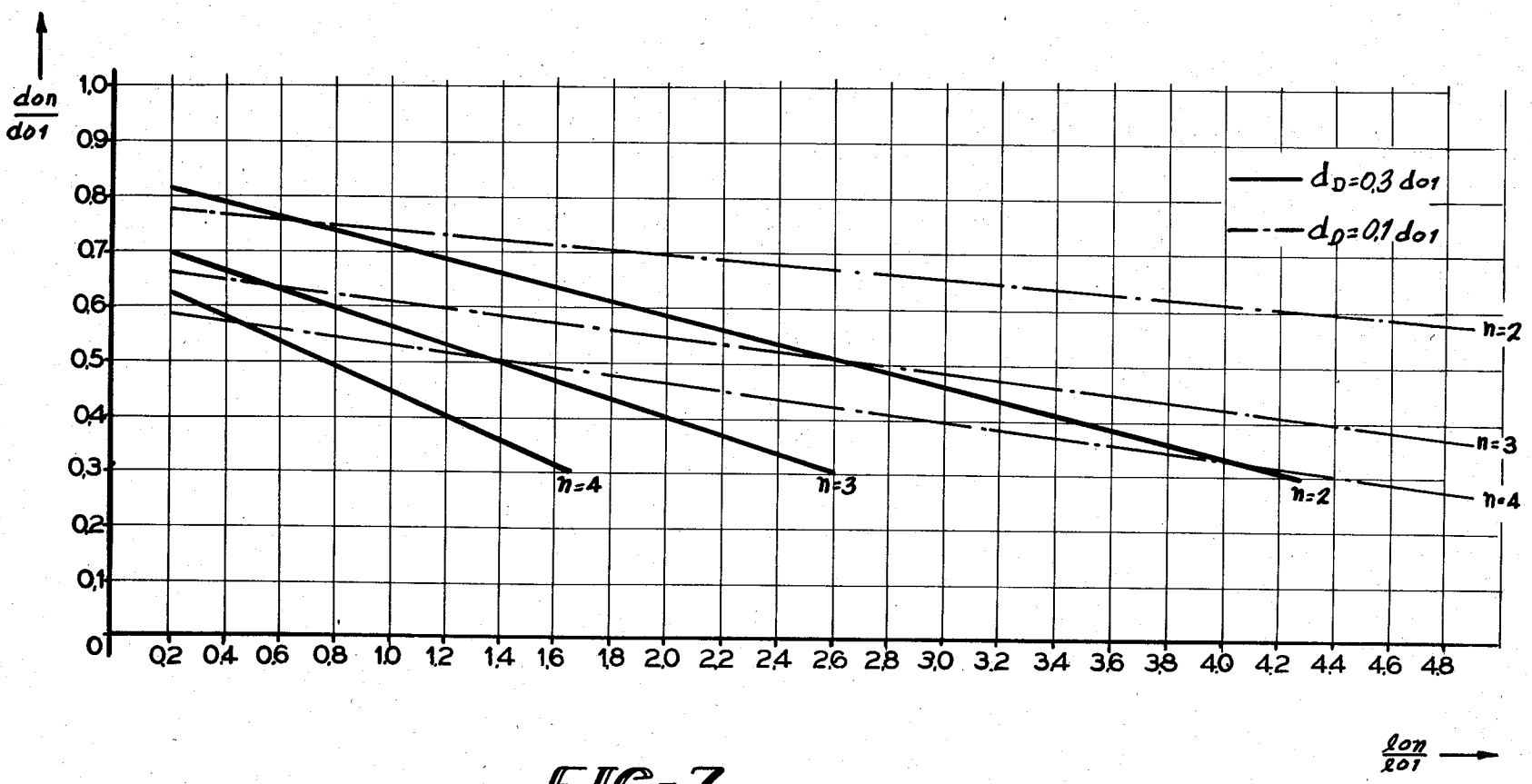
FIG. 7: Illustrates the diameter and length relationship of the billets when extruding a plurality of billets simultaneously by indirect extrusion over a mandrel.

This equation is solved for $d_D=0.3\ d_{o1}$ and for $d_D=0.1\ d_{o1}$ yielding the straight live curves shown in FIG. 7.

The volume of a pierced billet is as follows:

$$V_{ol} = \frac{\pi \cdot d_{ol}^2}{4} \cdot l_{ol} - \frac{\pi \cdot d_D^2}{4} \cdot l_{ol} \quad (4)$$

where the symbols have the meanings listed above.

Calculation of the volume of one of n billets with dimensions $d_{on}$; $l_{on}$ yields the following $$V_{on} = \frac{\pi \cdot d_{on}^2}{4} \cdot l_{on} - \frac{\pi \cdot d_D^2}{4} \cdot l_{on} \quad (5)$$

The calculation of the volume relationship of n billets of dimensions $d_{on}$; $l_{on}$ compared with the volume of one billet of dimensions $d_{o1}$; $l_{o1}$ can be obtained from equations (4) and (5)

$$\frac{n \cdot V_{on}}{V_{ol}} = \frac{\frac{n \cdot \pi \cdot d_{on}^2}{4} \cdot l_{on} - \frac{n \cdot \pi \cdot d_D^2}{4} \cdot l_{on}}{\frac{\pi \cdot d_{ol}^2}{4} \cdot l_{on} - \frac{\pi \cdot d_D^2}{4} \cdot l_{ol}} \quad (6)$$

Equation (6) can be simplified to $$\frac{n \cdot V_{on}}{V_{o1}} = n \cdot \left(\frac{d_{on}}{d_{o1}}\right)^2 \cdot \frac{l_{on}}{l_{o1}} \cdot \frac{1 - \left(\frac{d_D}{d_{on}}\right)^2}{1 - \left(\frac{d_D}{d_{o1}}\right)^2} \quad (7)$$

From FIG. 7 it can be seen that there is a linear relationship between $l_{on}/l_{o1}$ and $d_{on}/d_{o1}$. This can be described as follows:

$$\frac{l_{on}}{l_{ol}} = \frac{\frac{d_{on}}{d_{ol}} - C}{m} \quad (8)$$

Coefficients c and m can be determined from FIG. 7. Combining equations (7) and (8) yields:

$$\frac{n \cdot V_{on}}{V_{on}} = n \cdot \left(\frac{d_{on}}{d_{o1}}\right)^2 \cdot \frac{\frac{d_{on}}{d_{o1}} - C}{m} \cdot \frac{1 - \left(\frac{d_D}{d_{on}}\right)^2}{1 - \left(\frac{d_D}{d_{o1}}\right)^2} \quad (9)$$

Equation (9) was solved for $d_{on}/d_{o1}=0.1$ to 1.0 and for $d_D=0.1\ d_{o1}$ and $d_D=0.3\ d_{o1}$. The results are plotted in FIG. 8.

When $$\frac{n \cdot V_{on}}{V_o} > 1$$

not only is the throughput volume greater with a plurality of billets but the productivity is also greater.

Figure 8:
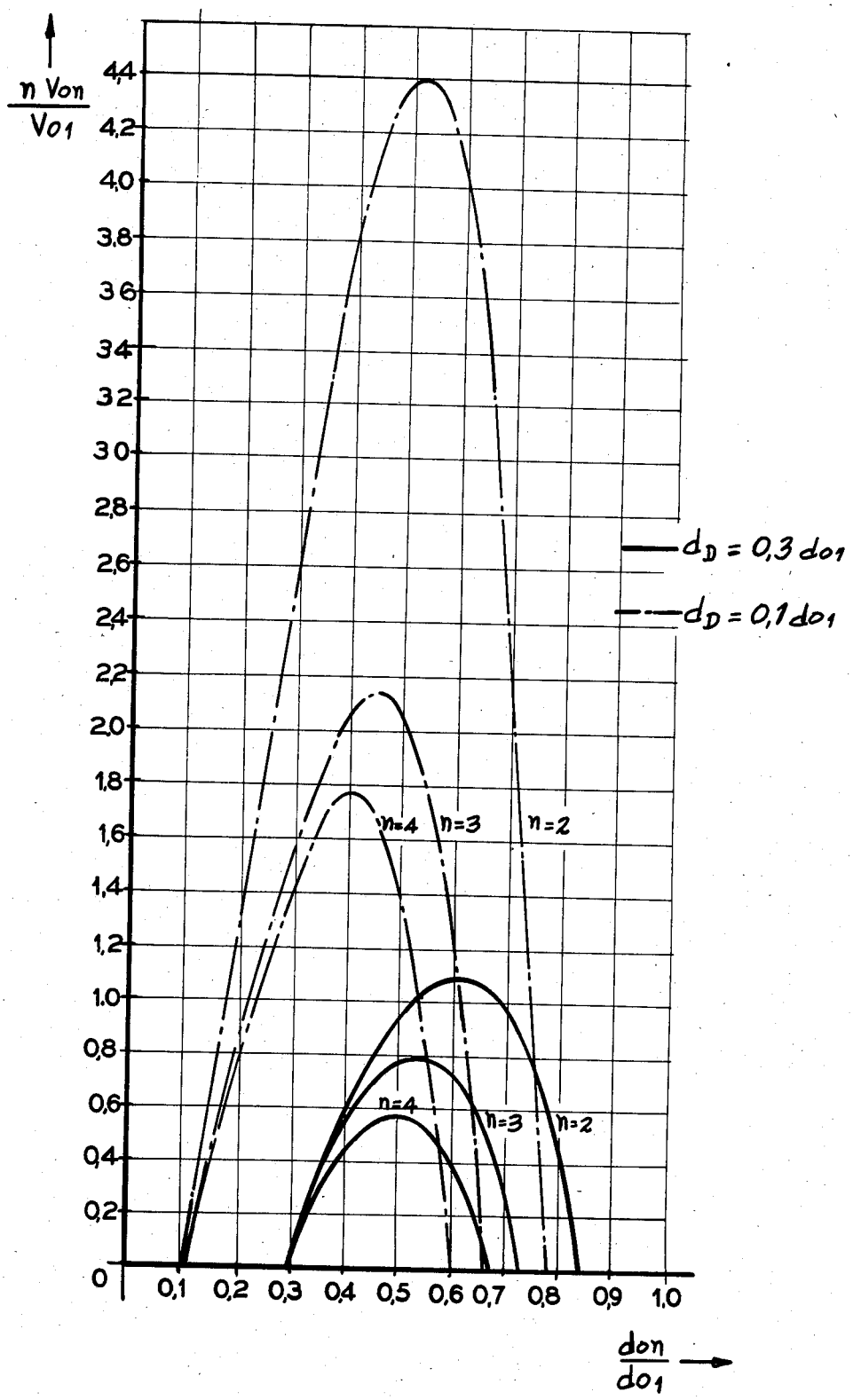
FIG. 8: A graph giving a summary of the results obtained in accordance with the present invention.

With reference to FIG. 8 it can be seen that the smaller the diameter $d_D$ of the mandrel the greater the volume throughput. For example, when extruding four billets where the diameter of each mandrel is one-tenth the diameter of each billet that is, $d_D=0.1\ d_{o1}$ maximum volume throughput is obtained when $d_{on}/d_{o1}=0.4$. When $d_D=0.1\ d_{o1}$, $(n \cdot V_{on})/V_o$ is greater than one only for two billets where $d_{on}/d_{o1} \simeq 0.6$. Thus, $d_D$ must be less than $0.4\ d_{on}$.

It should be noted that the diameter of the billet is assumed to be the same as the diameter of the channel in the container in which the billet is located and that the outside diameter of the mandrel is assumed to be the diameter of the hole in the hollow billet.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An extrusion press for manufacturing seamless pipe or hollow section extrusions from metal hollow billets by indirect extrusion which comprises a movable container, a plurality of channels in said container, a plurality of extrusion stems each of which is adapted to be received within one of the plurality of channels in the container, a plurality of shape-giving stationary dies each mounted on one of said plurality of extrusion stems in operative relationship to each of said channels, means for fixing said hollow billets adjacent each of said dies, a compression cylinder in operative relationshhip to each of said dies for pressing said hollow billets therethrough wherein said container is movable with said compression cylinder at the same speed thereof, and a plurality of mandrels mounted on said compression cylinder and movable therewith in the extrusion direction towards the corresponding die, said mandrels being provided in line with said channels and said dies wherein each hollow billet is deformed in said shape-giving stationary die wherein the diameter of each mandrel $d_D$ is less than 0.4 times the diameter of its corresponding billet to be extruded ($d_{on}$).

2. Extrusion press according to claim 1 wherein said mandrels are exchangeable.

3. Extrusion press according to claim 2 wherein said mandrels are adjustable in a direction parallel to the axis of the press.

4. Extrusion press according to claim 1 wherein said mandrels and the corresponding channels in the container have different cross sections.

5. Extrusion press according to claim 1 wherein the mandrels project out in the extrusion direction from the compression cylinder.

6. Extrusion press according to claim 1 wherein the mandrels project out in the extrusion direction from a common compression cylinder.

7. Extrusion press according to claim 1 wherein the mandrel are axially slidable in the extrusion direction.

8. Extrusion press according to claim 7 wherein the mandrels are axially slidable in the extrusion stems.

9. Extrusion press according to claim 7 wherein the mandrels are axially slidable in the compression cylinder.

10. Extrusion press according to claim 1 wherein said mandrels are mounted on a piercer associated with said compression cylinder and movable therewith.

11. Extrusion press according to claim 1 wherein the mandrels are provided with drive means to enable adjustment thereof.

12. Extrusion press according to claim 1 wherein a common container is provided for simultaneously accommodating a plurality of hollow billets.

13. Extrusion press according to claim 12 including a plurality of mandrels aligned with a plurality of dies and mounted on a common, movable compression cylinder.

14. Extrusion press according to claim 1 wherein said extrusion stems are stationary hollow stems.

15. Extrusion press according to claim 14 wherein said dies are stationary and seat on said stems.

16. Extrusion press according to claim 1 wherein said container channels and hollow billets are fixed with respect to each other.

* * * * *